US010128614B2

(12) United States Patent
Suzuki et al.

(10) Patent No.: US 10,128,614 B2
(45) Date of Patent: Nov. 13, 2018

(54) MOVABLE CONNECTOR

(71) Applicant: IRISO ELECTRONICS CO., LTD., Kanagawa (JP)

(72) Inventors: Hitoshi Suzuki, Kanagawa (JP); Hiroaki Kobayashi, Kanagawa (JP); Yoshiyuki Ogura, Kanagawa (JP); Tomomitsu Saito, Kanagawa (JP); Daichi Shimba, Kanagawa (JP)

(73) Assignee: IRISO ELECTRONICS CO., LT., Kanagawa (JP)

( * ) Notice: Subject to any disclaimer, the term of this patent is extended or adjusted under 35 U.S.C. 154(b) by 0 days.

(21) Appl. No.: 15/886,983

(22) Filed: Feb. 2, 2018

(65) Prior Publication Data

US 2018/0241155 A1 Aug. 23, 2018

(30) Foreign Application Priority Data

Feb. 17, 2017 (JP) ..... 2017-028173

(51) Int. Cl.

| | |
|---|---|
| ***H01R 13/631*** | (2006.01) |
| ***H01R 13/11*** | (2006.01) |
| ***H01R 13/502*** | (2006.01) |
| ***H01R 12/91*** | (2011.01) |

(52) U.S. Cl.

CPC ..... *H01R 13/6315* (2013.01); *H01R 12/91* (2013.01); *H01R 13/11* (2013.01); *H01R 13/502* (2013.01)

(58) Field of Classification Search

CPC .. H01R 13/6315; H01R 13/115; H01R 13/11; H01R 13/10; H01R 12/91

See application file for complete search history.

(56) References Cited

U.S. PATENT DOCUMENTS

| | | | | |
|---|---|---|---|---|
| 5,306,168 | A * | 4/1994 | Kunishi | H01R 13/6315 439/248 |
| 8,585,421 | B2 * | 11/2013 | Yamaguchi | H01R 13/05 439/248 |
| 9,502,815 | B2 * | 11/2016 | Akiguchi | H01R 13/10 |
| 9,583,869 | B2 * | 2/2017 | Shindo | H01R 13/533 |
| 9,887,484 | B1 * | 2/2018 | Hu | H01R 13/502 |
| 2013/0084751 | A1 * | 4/2013 | Shindo | H01R 13/6315 439/626 |

(Continued)

FOREIGN PATENT DOCUMENTS

JP 2015-146289 A 8/2015

*Primary Examiner* — Briggitte R Hammond

(74) *Attorney, Agent, or Firm* — Cermak Nakajima & McGowan LLP; Tomoko Nakajima

(57) ABSTRACT

A movable connector with which an insertion force of a connection object that places a load on a solder portion can be reduced, that has a floating function, and that can be reduced in size is provided. As a result of a pushing operation in which an operation housing is pushed into a fixed housing, a relay terminal is conductively connected to a substrate connection terminal, which is in conductive contact with a substrate, and a pin terminal, which is disposed in a movable housing and serves as the connection object, in the movable housing. Accordingly, the overall size of the movable connector can be reduced. In addition, the insertion force applied to the pin terminal is not applied to the solder portion by which the movable connector is fixed to the substrate, so that conduction failure does not occur.

9 Claims, 14 Drawing Sheets

(56) References Cited

U.S. PATENT DOCUMENTS

| | | | | |
|---|---|---|---|---|
| 2015/0111419 | A1* | 4/2015 | Komiyama ..... | H01R 13/11<br>439/510 |
| 2015/0222046 | A1 | 8/2015 | Akiguchi et al. | |

* cited by examiner

MOVABLE CONNECTOR

BACKGROUND OF THE INVENTION

1. Field of the Invention

The present invention relates to a connector having a floating function.

2. Description of the Related Art

A bottom entry connector is an example of a known connector that connects a connection object to a circuit on a substrate (see, for example, Japanese Unexamined Patent Application Publication No. 2015-146289, FIG. 3). This type of connector includes a terminal that comes into conductive contact with a connection object (for example, a pin terminal of an electric element) and a housing that holds the terminal. A surface of the housing that opposes the substrate has an insertion opening that communicates with a through hole in the substrate. To conductively connect the connection object to the connector, the connection object is inserted into the housing through the through hole and the insertion opening in the housing from the back of the substrate, and is brought into conductive contact with a contact portion of the terminal in the housing.

The connector according to Japanese Unexamined Patent Application Publication No. 2015-146289 includes a female type terminal (10) including a box-shaped first female terminal (11) and a box-shaped second female terminal (12) that are arranged next to each other. The first female terminal (11) is in conductive contact with a first male type terminal (3) mounted on a substrate. The second female terminal (12) is in conductive contact with a second male type terminal (4) that is inserted through a through hole in the substrate. Since the first female terminal (11) and the second female terminal (12) of the female type terminal (10) are box-shaped, the overall size of the connector including them is large. Also, the first female terminal (11) and the second female terminal (12) are arranged side by side along the substrate, and this also increases the size of the connector. This connector also includes a coupling spring (20) that couples the first female terminal (11) and the second female terminal (12) to each other and that provides a floating function. When the connector is vibrated, the first female terminal (11) and the second female terminal (12) are independently movable. However, since the coupling spring (20) is S-shaped, the spring length thereof cannot be easily increased.

SUMMARY OF THE INVENTION

The present invention has been made in light of the above-described related art. An object of the present invention is to provide a movable connector that has a floating function and that can be reduced in size.

To achieve the above-described object, the present invention has the following characteristics.

A movable connector according to the present invention includes a fixed housing to be fixed to a substrate; a movable housing disposed in the fixed housing and into which a connection object is to be inserted; a substrate connection terminal including a substrate connection portion to be soldered to the substrate, a support spring that supports the movable housing so that the movable housing is movable with respect to the fixed housing, and an inner contact section disposed in the movable housing; an operation housing that is combined with the movable housing as a result of a pushing operation in which the operation housing is pushed into an interior space of the fixed housing; and a relay terminal that moves together with the operation housing in the pushing operation and comes into conductive contact with the connection object and the inner contact section of the substrate connection terminal in the movable housing.

According to present invention, the relay terminal can be brought into conductive contact with the connection object and the inner contact section of the substrate connection terminal in the movable housing. Therefore, the overall size of the connector can be made smaller than the connector according to the related art in which the above-described first female terminal and the second female terminal are arranged in parallel. In addition, since the relay terminal is brought into conductive contact with the connection object and the inner contact section of the substrate connection terminal as a result of the pushing operation of the operation housing, the relay terminal can be easily brought into conductive contact with the connection object. In addition, since the connection object can be placed in the movable housing without being in conductive contact with the relay terminal before the pushing operation, the connector can be formed as a zero insertion force (ZIF) connector. Furthermore, since the relay terminal is moved and brought into conductive contact with the connection object placed in the movable housing as a result of the pushing operation of the operation housing, the insertion force applied to the connection object is not applied to the solder portion by which the movable connector is fixed to the substrate. Accordingly, conduction failure does not occur.

The interior space of the fixed housing according to the present invention may include a housing accommodating section that accommodates the movable housing and the operation housing and a support spring accommodating section in which the support spring extends.

According to present invention, since the support spring accommodating section may be provided separately from the housing accommodating section that accommodates the movable housing and the operation housing, the spring length can be increased without making the shape of the support spring complex.

The substrate connection terminal according to the present invention may include a first contact piece that comes into pressure contact with the relay terminal in the pushing operation.

According to present invention, the first contact piece of the substrate connection terminal comes into pressure contact with the relay terminal. Therefore, even when the movable connector is vibrated or receives an impact, the conductive contact between the first contact piece and the relay terminal can be reliably maintained due to the contact pressure applied by the first contact piece. The first contact piece may be formed as a cantilever-shaped contact spring.

The relay terminal according to the present invention may include a second contact piece that comes into pressure contact with the connection object and the substrate connection terminal in the pushing operation.

According to present invention, the second contact piece of the relay terminal comes into pressure contact with both the connection object and the substrate connection terminal. Therefore, even when the movable connector is vibrated or receives an impact, the conductive contact between the second contact piece and each of the connection object and the substrate connection terminal can be reliably maintained due to the contact pressure applied by the second contact piece. The second contact piece may be formed as a cantilever-shaped contact spring.

The second contact piece according to the present invention may include a first contact portion that comes into conductive contact with the connection object; a second contact portion that comes into pressure contact with the substrate connection terminal; and a spring portion that connects the first contact portion to the second contact portion and exerts a reaction force that presses the first contact portion against the connection object when the second contact portion comes into pressure contact with the substrate connection terminal.

According to present invention, the first contact portion can be pressed against the connection object by using the reaction force generated when the second contact portion comes into pressure contact with the substrate connection terminal. Thus, the contact pressure between the first contact portion and the connection object can be increased.

The relay terminal according to the present invention may include a projection, and the operation housing may have a retaining groove in which the projection is retained in a movable manner with a gap provided therebetween. The relay terminal may be movable with respect to the operation housing over a range defined by the gap.

According to present invention, the relay terminal is not fixed to the operation housing, and is movable. Therefore, even when the substrate connection terminal or the connection object comes into contact with the relay terminal in a displaced manner, the relay terminal is capable of moving so as to absorb the displacement. Thus, the connection reliability of the conductive contact can be increased.

The substrate connection terminal according to the present invention may include a first base portion held by the movable housing, and the relay terminal may include a second base portion held by the operation housing. The first base portion and the second base portion may be arranged in a pushing direction in which the operation housing is pushed in the pushing operation.

According to present invention, the first base portion of the substrate connection terminal and the second base portion of the relay terminal are arranged in the pushing direction. In other words, the substrate connection terminal and the relay terminal are arranged in series in the pushing direction. Therefore, the dimension of the movable connector in a direction that crosses the pushing direction can be reduced.

The operation housing and the movable housing according to the present invention may include temporarily-fitted-state retaining portions that restrain a movement of the operation housing in a pushing direction in which the operation housing is pushed in the pushing operation and a pulling direction that is opposite to the pushing direction in a temporarily fitted state before the operation housing and the movable housing are combined together in a completely fitted state.

According to present invention, the temporarily-fitted-state retaining portions restrain the operation housing from being pushed into or pulled out of the movable housing. Therefore, the operation housing can be prevented from falling, for example, in the temporarily fitted state.

The operation housing and the movable housing according to the present invention include completely-fitted-state retaining portions that restrain a movement of the operation housing in a pulling direction in which the operation housing is pulled out of the movable housing in a completely fitted state in which the operation housing and the movable housing are combined together.

According to present invention, the completely-fitted-state retaining portions restrain the operation housing from being pulled out of the movable housing in the completely fitted state. Thus, the completely fitted state can be reliably maintained.

The movable connector of the present invention is structured such that the relay terminal is brought into conductive contact with the connection object and the inner contact section of the substrate connection terminal in the movable housing. Therefore, the overall size of the movable connector can be made smaller than the connector according to the related art. In addition, the insertion force applied to the connection object is not applied to the solder portion by which the movable connector is fixed to the substrate, so that the reliability of conductive connection can be increased. In addition, the spring length can be increased without making the shape of the support spring complex, so that a floating function for softly supporting the movable housing can be provided.

DESCRIPTION OF THE PREFERRED EMBODIMENTS

Figure 1:
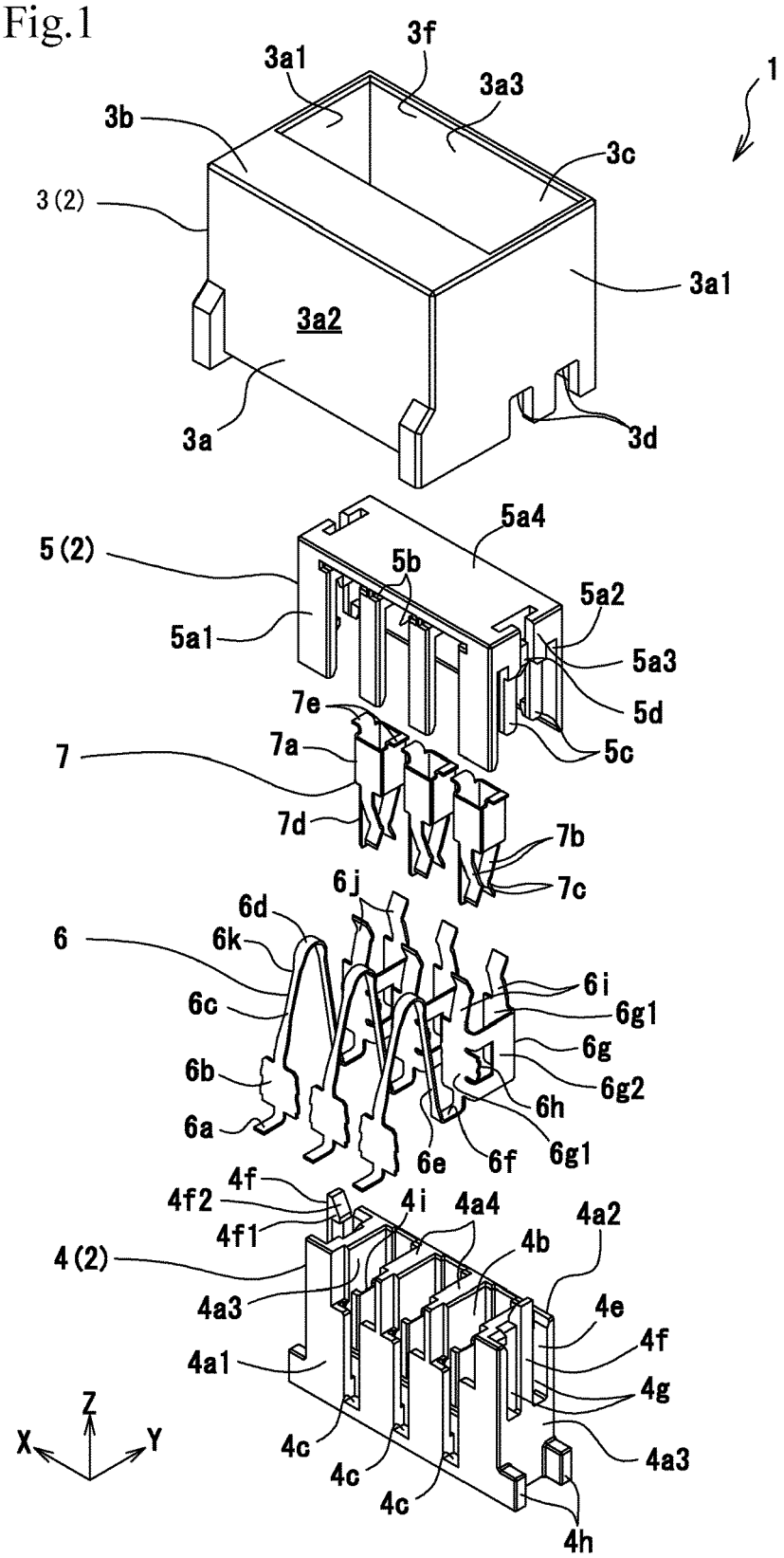
FIG. 1 is an exploded perspective view of a movable connector according to a first embodiment showing the front, right, and top sides.
Figure 2:
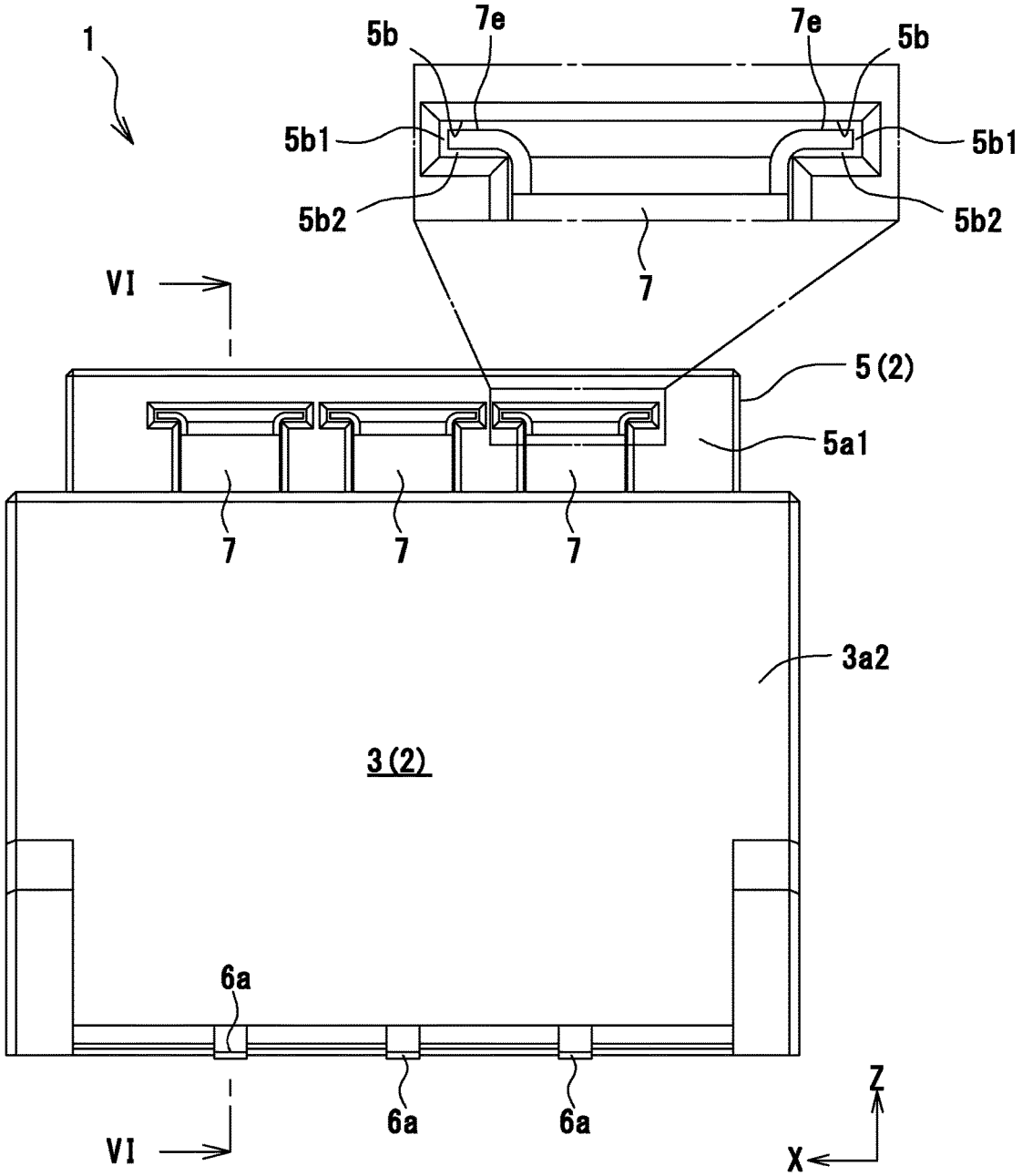
FIG. 2 is a front view of the movable connector illustrated in FIG. 1.
Figure 3:
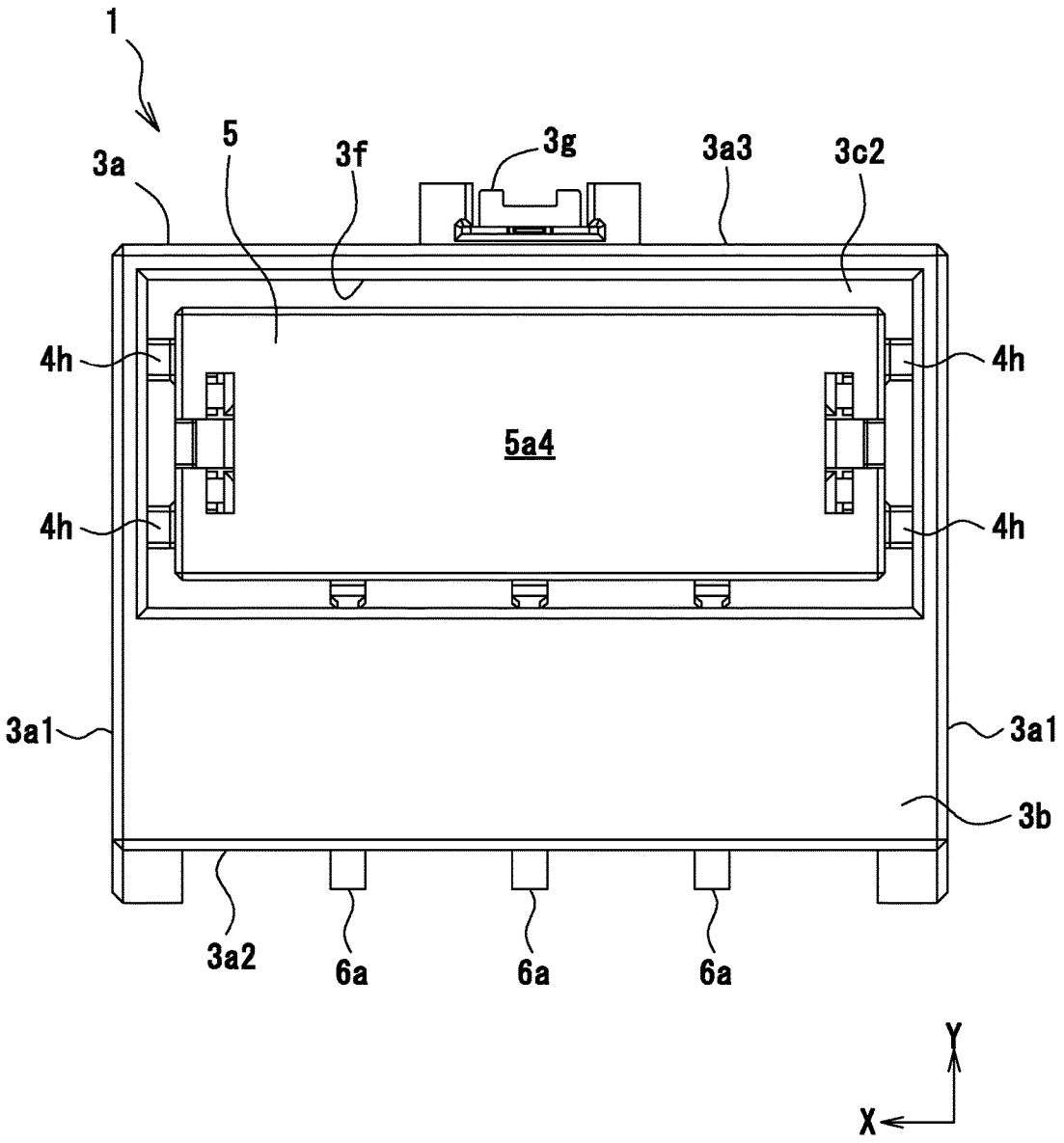
FIG. 3 is a plan view of the movable connector illustrated in FIG. 1.

Embodiments of the present invention will now be described with reference to the drawings. Bottom entry movable connectors 1 according to the embodiments will be described. In this specification, claims, and drawings, the direction in which terminals of the movable connector 1 illustrated in FIG. 1 are arranged (left-right direction) is defined as an X direction, a depth direction of the movable connector 1 (front-back direction) is defined as a Y direction, and a height direction of the movable connector 1 (up-down direction) is defined as a Z direction. The definitions of the left-right, front-back, and up-down directions do not limit the direction in which the movable connector according to the present invention is mounted or used.

First Embodiment (FIGS. 1 to 10)

Structure of Movable Connector 1

The movable connector 1 includes a housing 2, which is a molded body made of a rigid resin. The housing 2 includes a fixed housing 3, a movable housing 4, and an operation housing 5. Reference numeral 6 denotes substrate connection terminals formed of metal pieces, and 7 denotes relay terminals formed of metal pieces. The substrate connection terminals 6 are fixed to the fixed housing 3 and the movable housing 4. The relay terminals 7 are held by the operation housing 5. Fixed Housing 3

Figure 9:
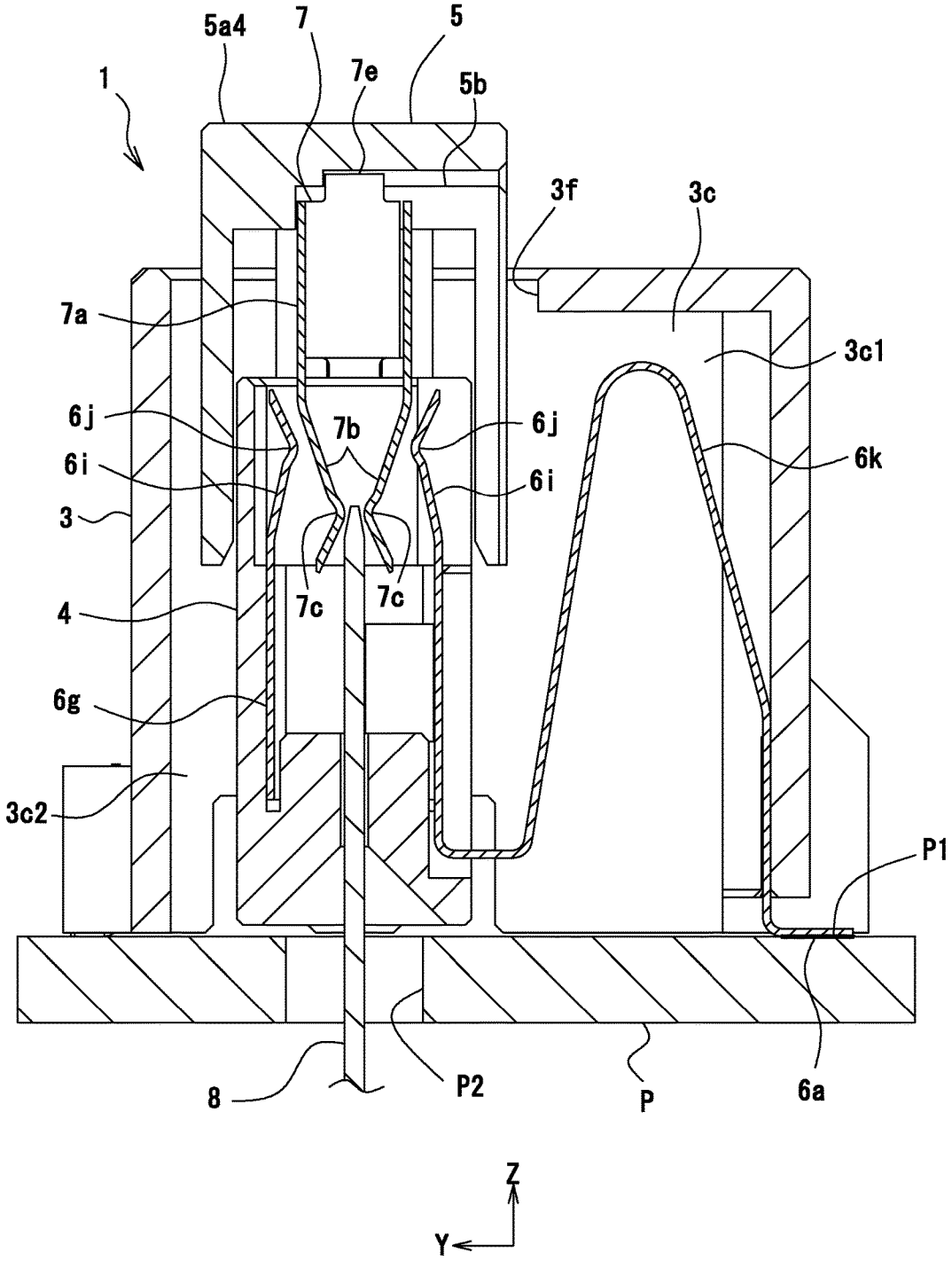
FIG. 9 is an enlarged sectional view corresponding to FIG. 6, illustrating the movable connector of FIG. 1 in a fitting process.

The fixed housing 3 is mounted on a substrate P (FIG. 9). The fixed housing 3 is box-shaped, and includes a tubular wall 3*a* and a top portion 3*b* that covers a front section in the Y direction at the top end of the tubular wall 3*a*. The fixed housing 3 defines an interior space 3*c* therein.

Figure 4:
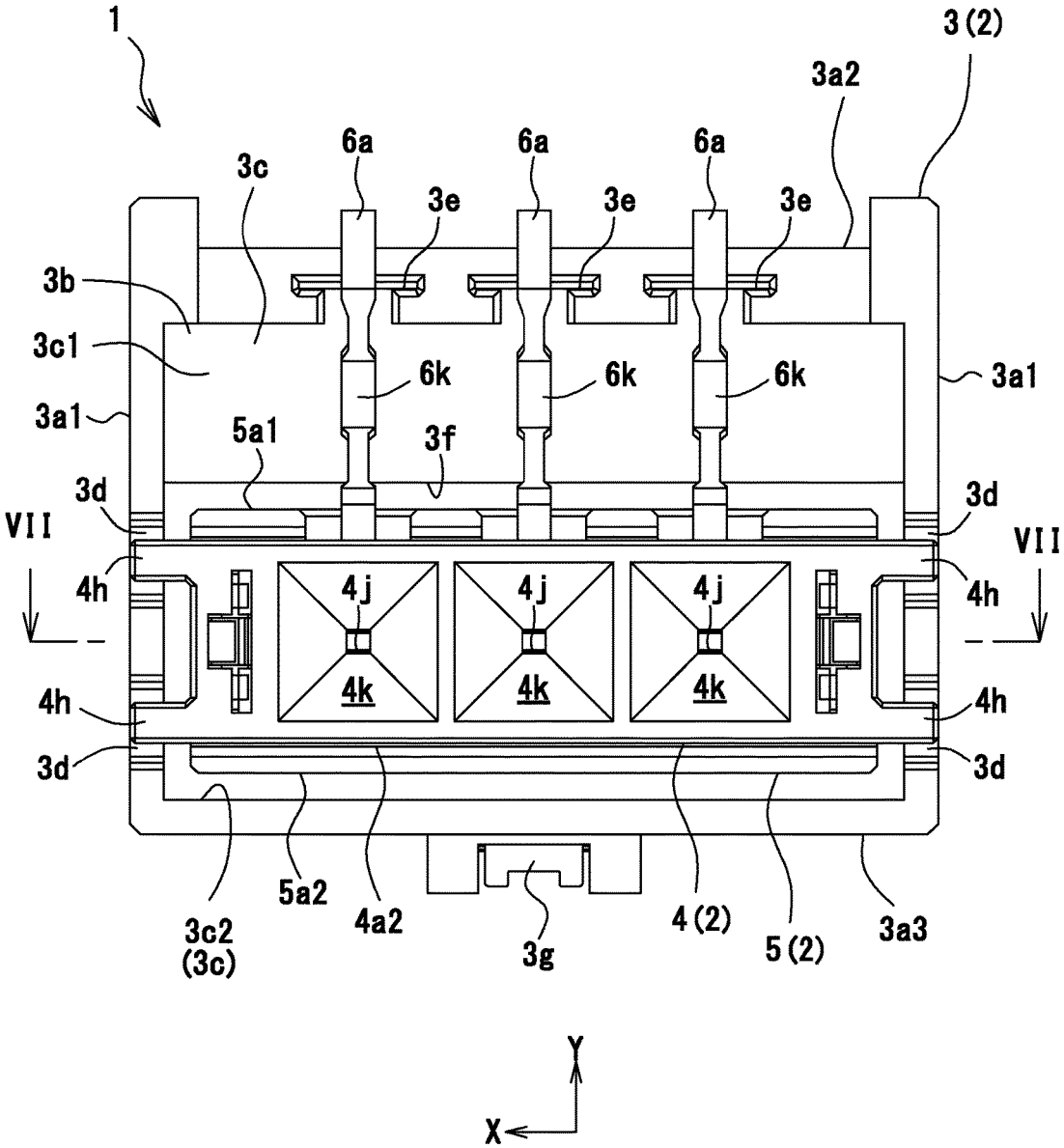
FIG. 4 is a bottom view of the movable connector illustrated in FIG. 1.

The tubular wall 3*a* includes left and right side walls 3*a*1 having engagement recesses 3*d* at the bottom ends thereof. The engagement recesses 3*d* engage with engagement projections 4*h* (described below) of the movable housing 4. The tubular wall 3*a* also includes a front wall 3*a*2 and a back wall 3*a*3. The front wall 3*a*2 has groove-shaped terminal fixing portions 3*e* on the inner side thereof. The terminal fixing portions 3*e* retain fixed-housing fixing portions 6*b* (described below) of the substrate connection terminals 6 in the X direction (FIG. 4).

The top portion 3*b* covers support springs 6*k* (described below) of the substrate connection terminals 6 from above to protect the support springs 6*k* by preventing them from being exposed to the outside. The opening at the top end of the tubular wall 3*a* where the top portion 3*b* is not formed serves as an insertion opening 3*f* in which the operation housing 5 is inserted. The insertion opening 3*f* is larger than the outer periphery of the operation housing 5.

In the interior space 3*c* of the fixed housing 3 having the above-described structure, the section below the top portion 3*b* serves as a support spring accommodating section 3*c*1 in which the support springs 6*k* of the substrate connection terminals 6 extend and which allows elastic deformation of the support springs 6*k*. The section below the insertion opening 3*f* serves as a housing accommodating section 3*c*2 that accommodates the operation housing 5 and the movable housing 4. Thus, in the interior space 3*c* of the fixed housing 3, a plurality of accommodating sections, which are the support spring accommodating section 3*c*1 and the housing accommodating section 3*c*2, are arranged next to each other in the Y direction. Since the interior space 3*c* includes the support spring accommodating section 3*c*1 separately from the housing accommodating section 3*c*2, the support spring accommodating section 3*c*1 can be used as a space in which the support springs 6*k* extend, bend, and move. Thus, the spring length of the support springs 6*k* can be increased without making the shape of the support springs 6*k* complex.

A fixing piece 3*g* that is soldered to the substrate P is attached to the back wall 3*a*3 of the fixed housing 3. The fixing piece 3*g* is fixed to the substrate P by a solder portion (not shown).

Movable Housing 4

Similar to the fixed housing 3, the movable housing 4 is arranged so that the longitudinal direction thereof is the X direction, and includes a front wall 4*a*1, a back wall 4*a*2, and left and right side walls 4*a*3. Two partition walls 4*a*4 that extend in the Y direction are formed between the front wall 4*a*1 and the back wall 4*a*2. Thus, the movable housing 4 includes three connection chambers 4*b* that are partitioned from each other in the X direction. Each connection chamber 4*b* receives a pin terminal 8, which serves as a "connection object", and serves as a space in which the pin terminal 8 comes into conductive contact with a pair of contact portions 7*c* (described below) of a corresponding one of the relay terminals 7.

Figure 8:
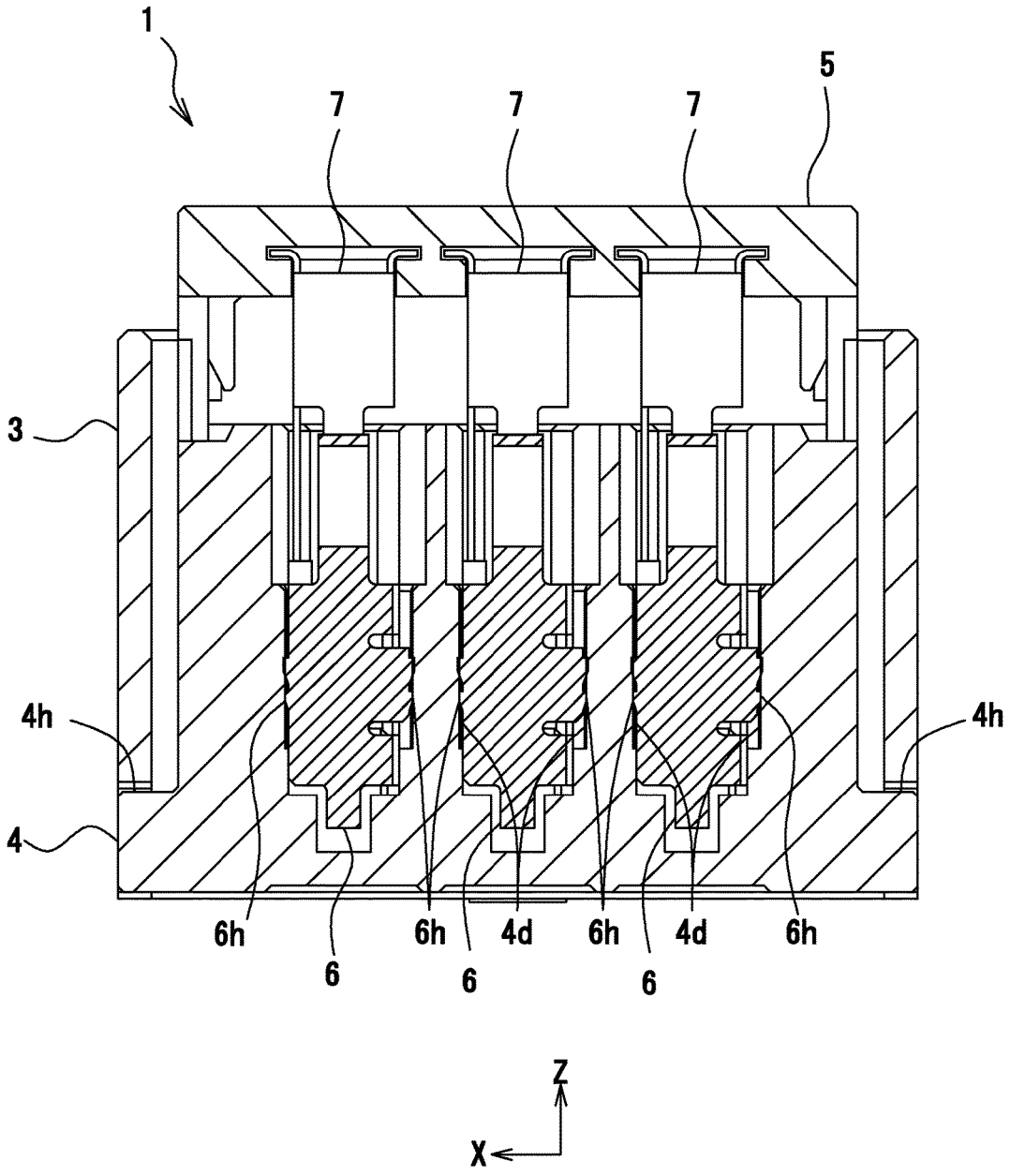
FIG. 8 is an enlarged sectional view of FIG. 6 taken along line VIII-VIII.

Insertion slits 4*c* are formed in the front wall 4*a*1. The insertion slits 4*c* connect the connection chambers 4*b* to the outside of the movable housing 4 in the Y direction, and accommodate horizontally bent portions 6*f* of the support springs 6*k* of the substrate connection terminals 6. The front wall 4*a*1 has groove-shaped terminal fixing portions 4*d* on the inner side thereof (FIG. 8). The terminal fixing portions 4*d* retain movable-housing fixing portions 6*h* (described below) of the substrate connection terminals 6 in the X direction.

Figure 7:
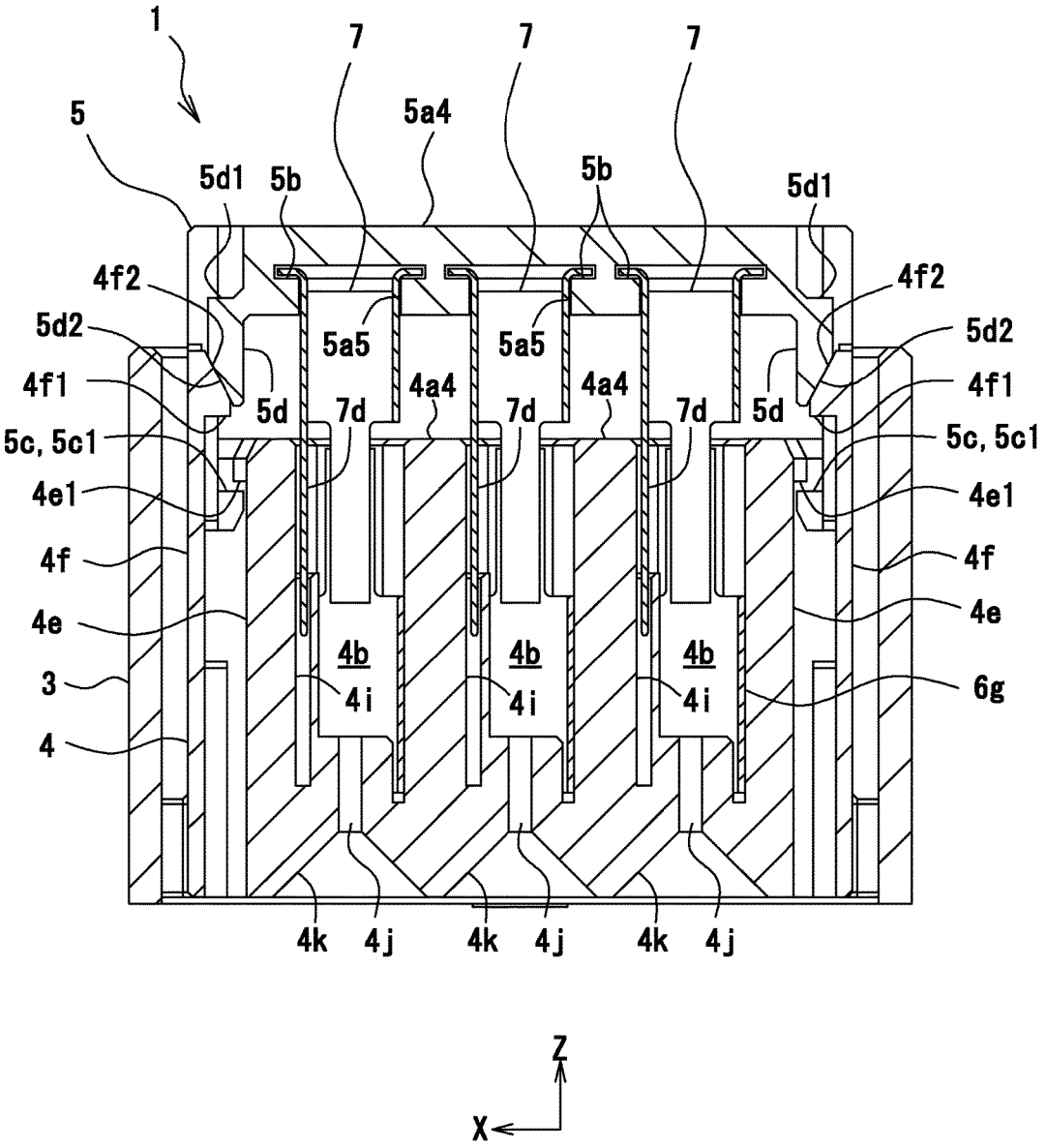
FIG. 7 is an enlarged sectional view of FIG. 4 taken along line VII-VII.

Long groove-shaped recesses 4*e* that extend in the Z direction are formed in the left and right side walls 4*a*3 (FIGS. 1 and 7). Engagement steps 4*e*1, which serve as "temporarily-fitted-state retaining portions" of the movable housing 4, are formed at the top edges of the recesses 4*e* (FIG. 7).

The side walls 4*a*3 have lock arms 4*f* that extend in the Z direction so as to oppose the respective recesses 4*e*. Long groove-shaped guide portions 4*g*, which extend in the Z direction, are formed between each recess 4*e* and side surfaces of the corresponding lock arm 4*f* that oppose each other in the Y direction (FIG. 1).

The engagement projections 4*h* are formed at the front and back ends of the bottom edge of each side wall 4*a*3. When the movable housing 4 is excessively moved in the interior space 3*c* of the fixed housing 3 in the Y or Z direction, the engagement projections 4*h* engage with the above-described engagement recesses 3*d* in the fixed housing 3 to serve as stoppers for stopping the movement.

Each connection chamber 4*b* has a sheath-shaped portion 4*i* that receives a thin-plate-shaped movement restricting piece 7*d* (described below) of the corresponding relay terminal 7. Each connection chamber 4*b* also has an insertion hole 4*j* for receiving the connection object in the bottom surface thereof. The insertion hole 4*j* has a tapered portion 4*k*, which guides insertion of the pin terminal 8, at the entrance thereof.

Operation Housing 5

Similar to the fixed housing 3 and the movable housing 4, the operation housing 5 is arranged so that the longitudinal direction thereof is the X direction, and includes a front wall 5*a*1, a back wall 5*a*2, left and right side walls 5*a*3, and a top wall 5*a*4. Two partition walls 5*a*5 are formed between the front wall 5*a*1 and the back wall 5*a*2 (FIG. 7). The partition walls 5*a*5 extend in the Y direction and project slightly downward in the Z direction from the bottom surface of the top wall 5a4. Retaining grooves 5b that extend in the Y direction are formed in proximal end portions of the partition walls 5a5 and inner surfaces of the left and right side walls 5a3 that oppose the proximal end portions in the X direction. Projections 7e of the relay terminals 7 are inserted in the retaining grooves 5b.

Each of the left and right side walls 5a3 has two stopper pieces 5c that extend downward in the Z direction from the side adjacent to the top wall 5a4 (FIGS. 1 and 7). The stopper pieces 5c serve as "temporarily-fitted-state retaining portions" of the operation housing 5. The stopper pieces 5c extend into the guide portions 4g on both sides of the above-described lock arms 4f of the movable housing 4. The stopper pieces 5c move along the guide portions 4g to guide the movement of the operation housing 5 in the Z direction. When the operation housing 5 is pulled in a direction away from the movable housing 4 in a temporarily fitted state (FIGS. 2 and 6 to 9) in which the operation housing 5 and the movable housing 4 are not yet completely fitted together, engagement lugs 5c1 of the stopper pieces 5c come into contact with the engagement steps 4e1 of the movable housing 4 and prevent the operation housing 5 from being pulled out of the movable housing 4 (FIG. 7).

Figure 10:
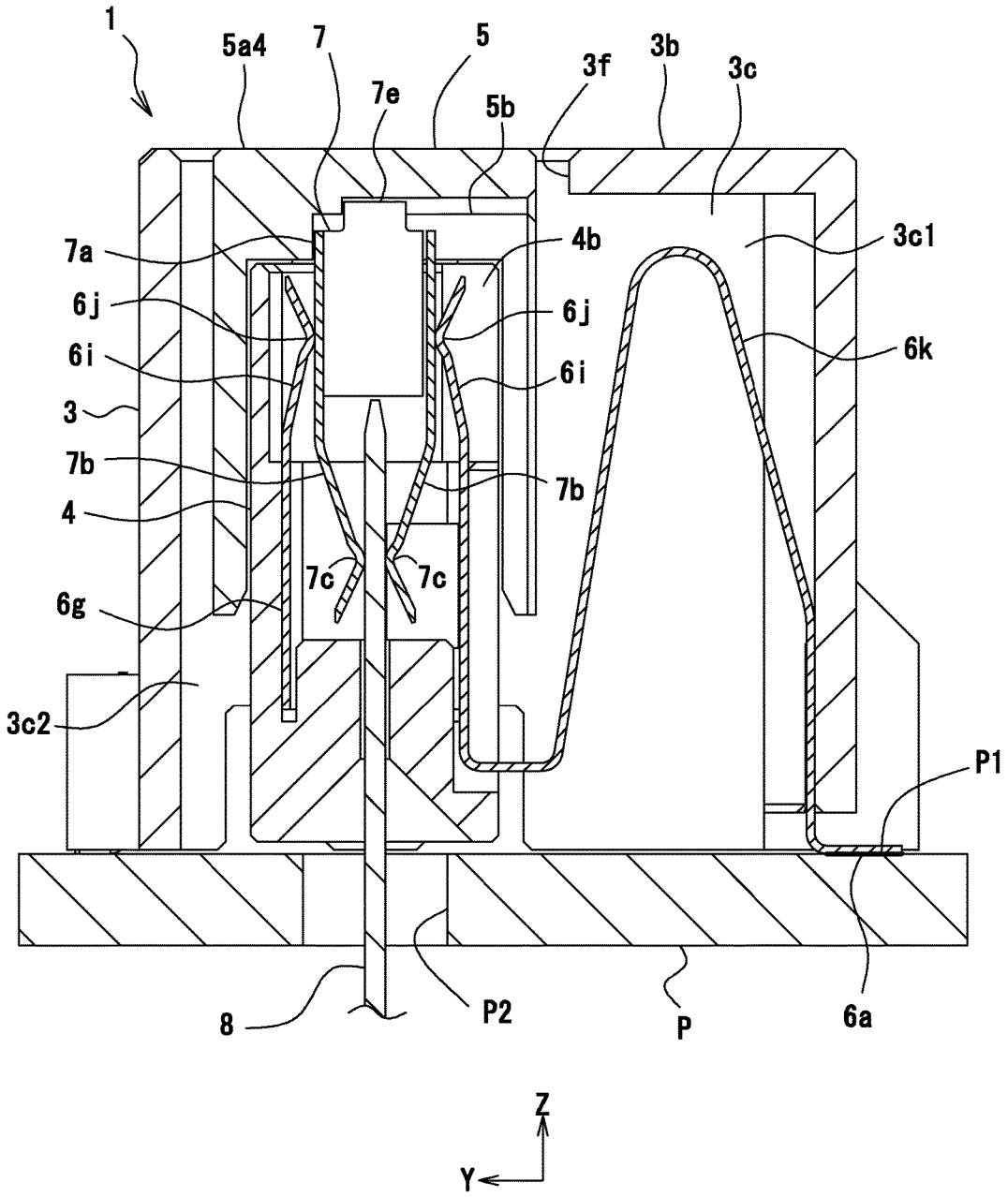
FIG. 10 is an enlarged sectional view corresponding to FIG. 6, illustrating the movable connector in a completely fitted state after the state illustrated in FIG. 9.
Figure 11:
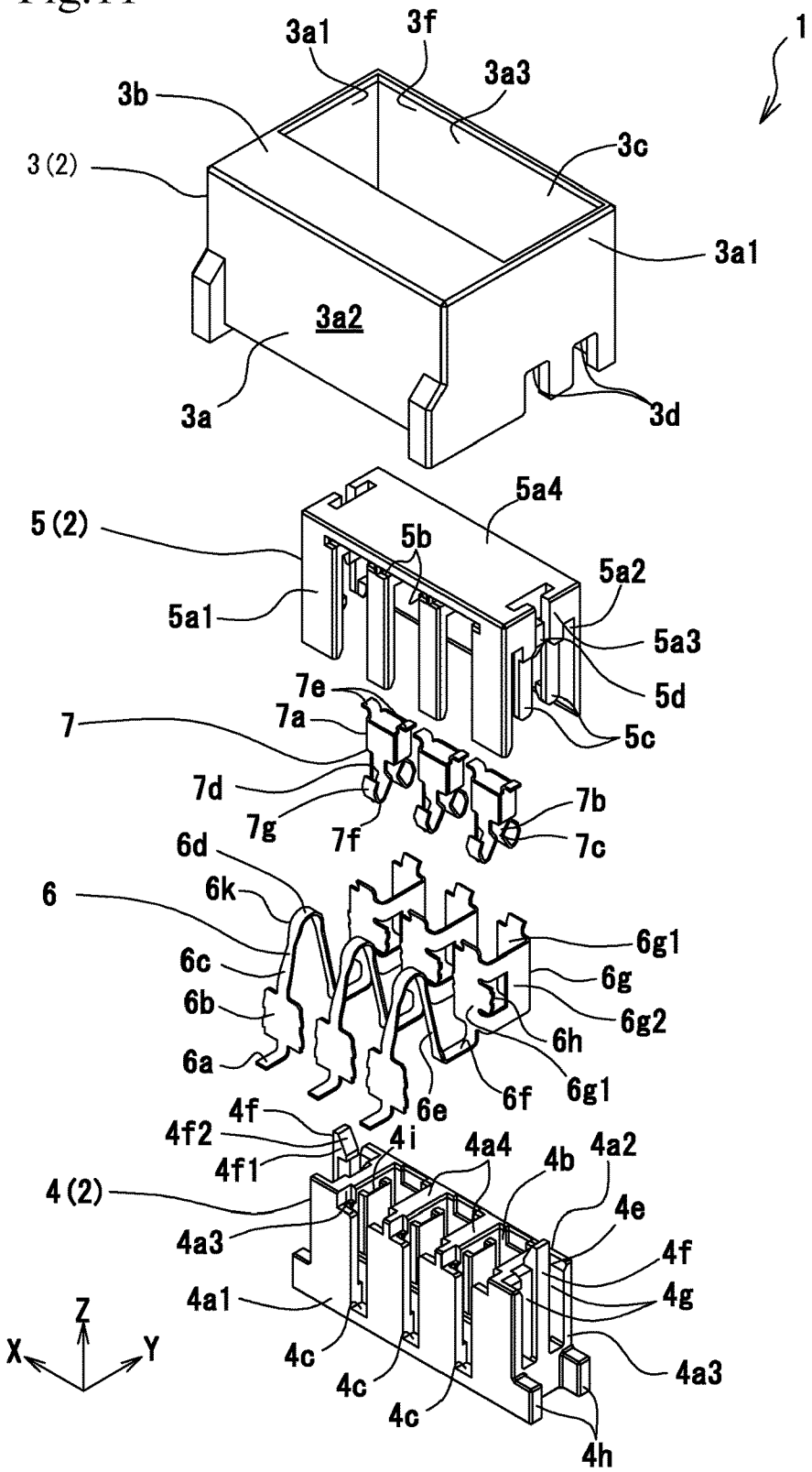
FIG. 11 is an exploded perspective view of a movable connector according to a second embodiment showing the front, right, and top sides.
Figure 12:
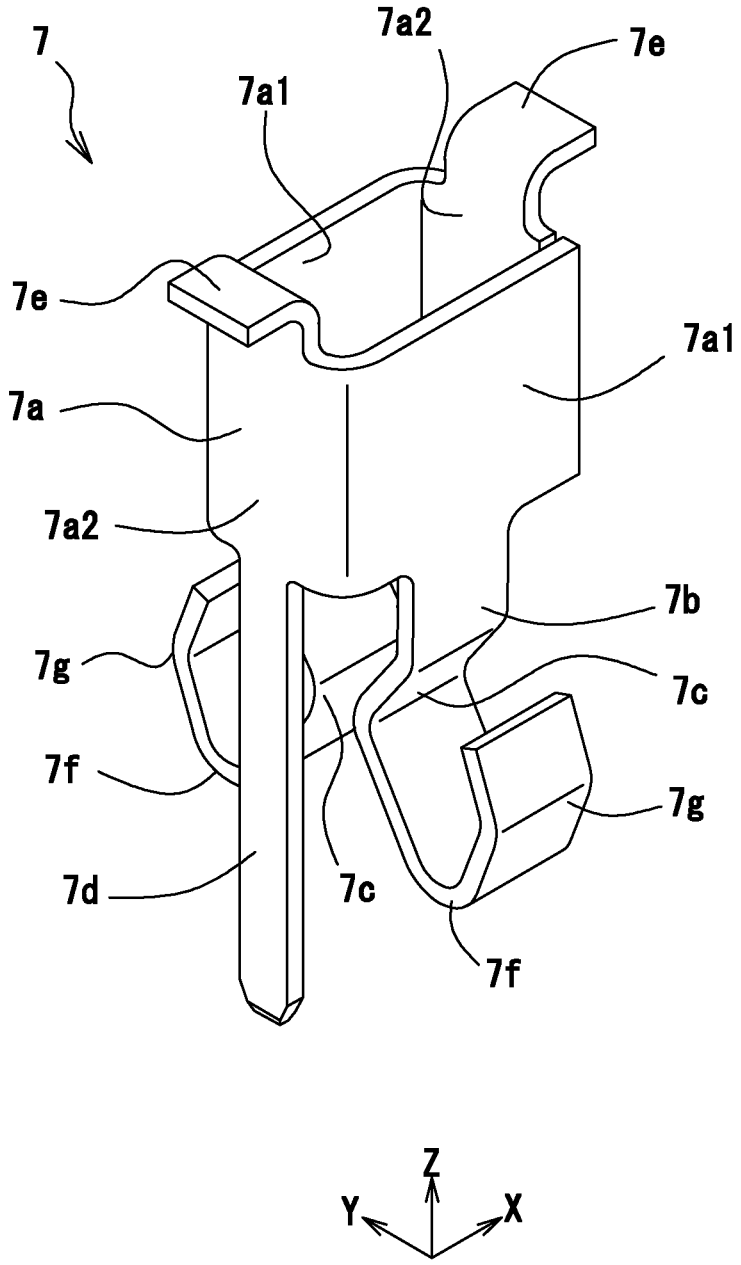
FIG. 12 is a perspective view of a relay terminal included in the movable connector illustrated in FIG. 11.

Each side wall 5a3 also has a locking projection 5d. The locking projection 5d has an engagement surface 5d1 that engages with an engagement lug 4f1 of the corresponding lock arm 4f of the movable housing 4 in the completely fitted state in which the operation housing 5 is completely fitted to the movable housing 4 as a result of a pushing operation in which the operation housing 5 is pushed into the interior space 3c of the fixed housing 3. The completely fitted state illustrated in FIG. 10 is maintained by the engagement between the engagement lug 4f1 and the engagement surface 5d1 in the pulling direction. The locking projection 5d and the engagement surface 5d1 thereof serve as "completely-fitted-state retaining portions" of the operation housing 5, and the lock arm 4f and the engagement lug 4f1 thereof serve as "completely-fitted-state retaining portions" of the movable housing 4.

The locking projection 5d also has an inclined surface 5d2. In the above-described temporarily fitted state (FIGS. 2 and 6 to 9), the inclined surface 5d2 is in contact with an inclined surface 4f2 provided at the top end of the lock arm 4f, and restricts the pushing operation of the operation housing 5 to maintain the temporarily fitted state. To fit the operation housing 5 to the movable housing 4, the operation housing 5 in the temporarily fitted state is pushed into the interior space 3c of the fixed housing 3. As a result of the pushing operation, the inclined surface 5d2 of the locking projection 5d pushes the inclined surface 4f2 of the lock arm 4f in the Z direction, and the lock arm 4f is outwardly bent due to the inclined surfaces 5d2 and 4f2 that are in contact with each other. When the locking projection 5d passes the engagement lug 4f1 of the lock arm 4f, the lock arm 4f returns from the bent state, and the engagement surface 5d1 of the locking projection 5d engages with the engagement lug 4f1 of the lock arm 4f. Thus, the operation housing 5 and the movable housing 4 are set to the completely fitted state.

The top wall 5a4 serves as a pushing operation surface in the pushing operation of the operation housing 5. To facilitate the pushing operation even when the movable connector 1 is small, the top wall 5a4 is formed to have a flat surface over the entire area thereof. When the operation housing 5 and the movable housing 4 are in the completely fitted state, the top wall 5a4 is positioned to be flush with the top portion 3b of the fixed housing 3. When the top wall 5a4 is positioned so as to project from the top portion 3b of the fixed housing 3, it means that the operation housing 5 and the movable housing 4 are not yet completely fitted together. Therefore, whether or not the completely fitted state is established can be determined by visually checking the position of the top wall 5a4.

Substrate Connection Terminals 6

The substrate connection terminals 6 are arranged in parallel in the X direction in the movable connector 1. The substrate connection terminals 6 have the same shape. More specifically, each substrate connection terminal 6 includes a substrate connection portion 6a, the fixed-housing fixing portion 6b, an outer vertical portion 6c, an acutely bent portion 6d, an inner vertical portion 6e, the horizontally bent portion 6f, a base portion 6g that serves as a "first base portion", the movable-housing fixing portions 6h, a pair of elastic arms 6i, and a pair of contact portions 6j.

The substrate connection portion 6a is conductively connected to a circuit on the substrate P by being fixed to the substrate P by a solder portion P1 (FIG. 9). The fixed-housing fixing portion 6b is press-fitted to and held by a corresponding one of the terminal fixing portions 3e on the inner surface of the front wall 3a2 of the fixed housing 3, so that one end of the substrate connection terminal 6 is fixed to the fixed housing 3. The outer vertical portion 6c, the acutely bent portion 6d, the inner vertical portion 6e, and the horizontally bent portion 6f constitute the support spring 6k that elastically supports the movable housing 4 and the operation housing 5 so that the movable housing 4 and the operation housing 5 are movable with respect to the fixed housing 3. The support spring 6k is bent in an inverted U-shape in the support spring accommodating section 3c1 of the fixed housing 3, and enables the movable housing 4 and the operation housing 5 to move in the X, Y, and Z directions by being elastically deformed in the X, Y, and Z directions in the support spring accommodating section 3c1. The horizontally bent portion 6f linearly extends in the Y direction above a corresponding one of the above-described insertion slits 4c in the movable housing 4. The base portion 6g includes a pair of plate pieces 6g1 that extend in the X direction and oppose each other in the Y direction and a plate piece 6g2 that extends in the Y direction and connects the plate pieces 6g1. The front plate piece 6g1 has a plurality of press-fitting projections on side edges thereof, the press-fitting projections being press-fitted to the terminal fixing portions 4d of the movable housing. The press-fitting projections serve as the movable-housing fixing portions 6h. The plate pieces 6g1 are connected to proximal ends of the elastic arms 6i at the top edges thereof. The elastic arms 6i function as spring pieces that support the contact portions 6j, which are bent in a sideways V-shape, in a movable manner, and exert a contact pressure for bringing the contact portions 6j into pressure contact with the corresponding relay terminal 7. The elastic arms 6i and the contact portions 6j serve as "inner contact sections" and "first contact pieces" according to the present invention. The contact portions 6j come into pressure contact with a base portion 7a of the relay terminal 7 so as to clamp the base portion 7a in the Y direction.

Relay Terminal 7

Figure 5:
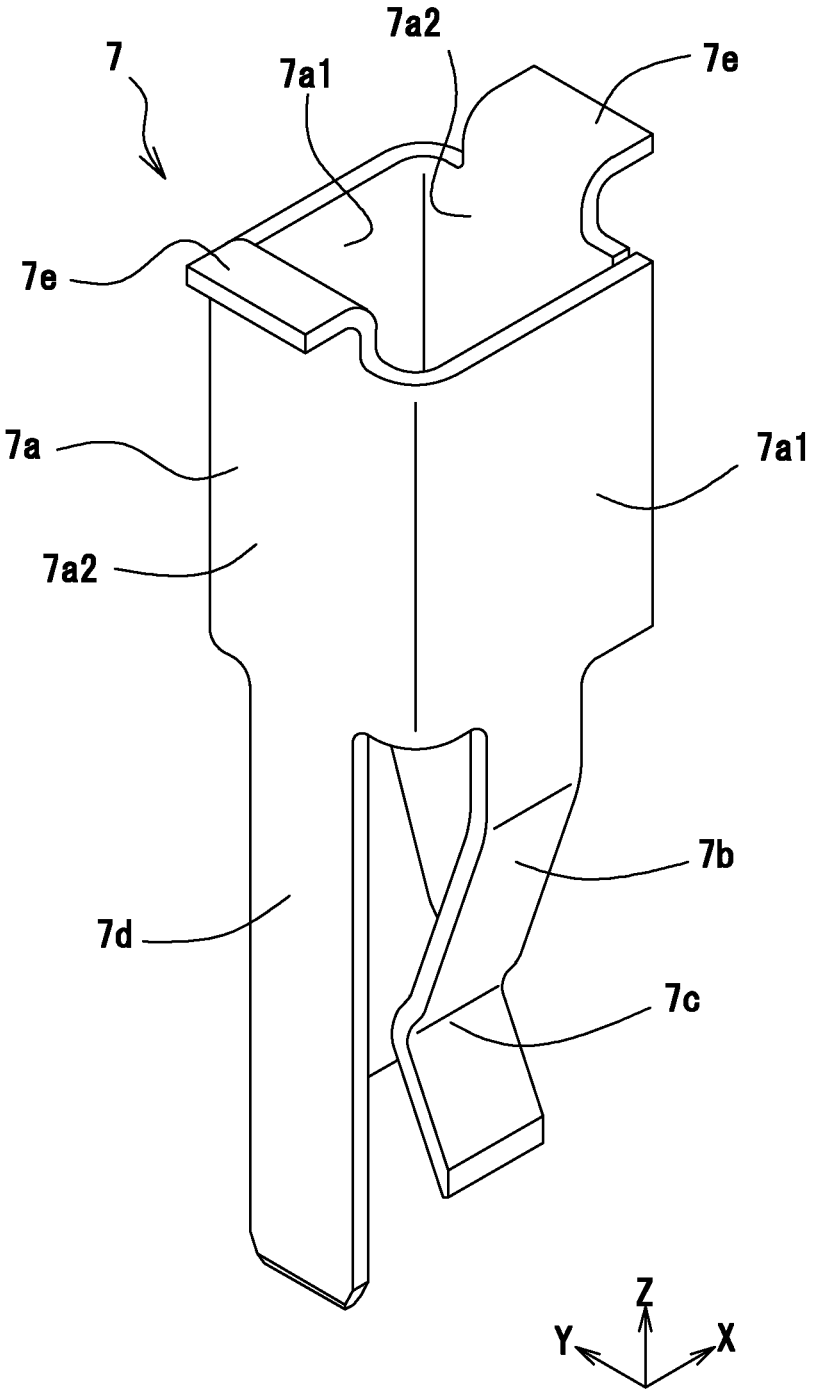
FIG. 5 is a perspective view of a relay terminal included in the movable connector illustrated in FIG. 1.

As illustrated in the enlarged view of FIG. 5, each relay terminal 7 includes the base portion 7a, which serves as a "second base portion", a pair of elastic arms 7*b*, the pair of contact portions 7*c*, the movement restricting piece 7*d*, and the projections 7*e*.

The base portion 7*a* has a rectangular tubular shape, and is capable of being inserted into the base portion 6*g* of the corresponding substrate connection terminal 6 in a nested manner. The base portion 7*a* includes a pair of plate pieces 7*a*1 that extend in the X direction. The plate pieces 7*a*1 are connected to proximal ends of the elastic arms 7*b*, which extend downward in the Z direction, at the bottom edges thereof. The elastic arms 7*b* function as spring pieces that support the contact portions 7*c*, which are bent in a sideways V-shape, in a movable manner, and exert a contact pressure for bringing the contact portions 7*c* into pressure contact with the pin terminal 8, which serves as a connection object. The elastic arms 7*b* and the contact portions 7*c* serve as contact pieces. The contact portions 7*c* come into pressure contact with the pin terminal 8 so as to clamp the pin terminal 8 in the Y direction.

The base portion 7*a* also includes a pair of plate pieces 7*a*2 that extend in the Y direction and oppose each other in the X direction. The thin-plate-shaped movement restricting piece 7*d*, which extends downward in the Z direction, is formed on the left plate piece 7*a*2. The movement restricting piece 7*d* is inserted in the corresponding sheath-shaped portion 4*i* of the movable housing 4, so that the relay terminal 7 is prevented from moving excessively with respect to the movable housing 4 and falling. The projections 7*e*, which are bent in the X direction in the shape of outwardly projecting flanges, are formed at the top edges of the plate pieces 7*a*2. The projections 7*e* are inserted in the respective retaining grooves 5*b* in the operation housing 5. The projections 7*e* are retained in the retaining grooves 5*b* with gaps therebetween so that the relay terminal 7 is movable with respect to the movable housing 4. The projections 7*e* and the retaining grooves 5*b* serve as movable retaining portions that are provided on the relay terminal 7 and the movable housing 4 and retain the relay terminal 7 such that the relay terminal 7 is movable with respect to the movable housing 4.

Figure 6:
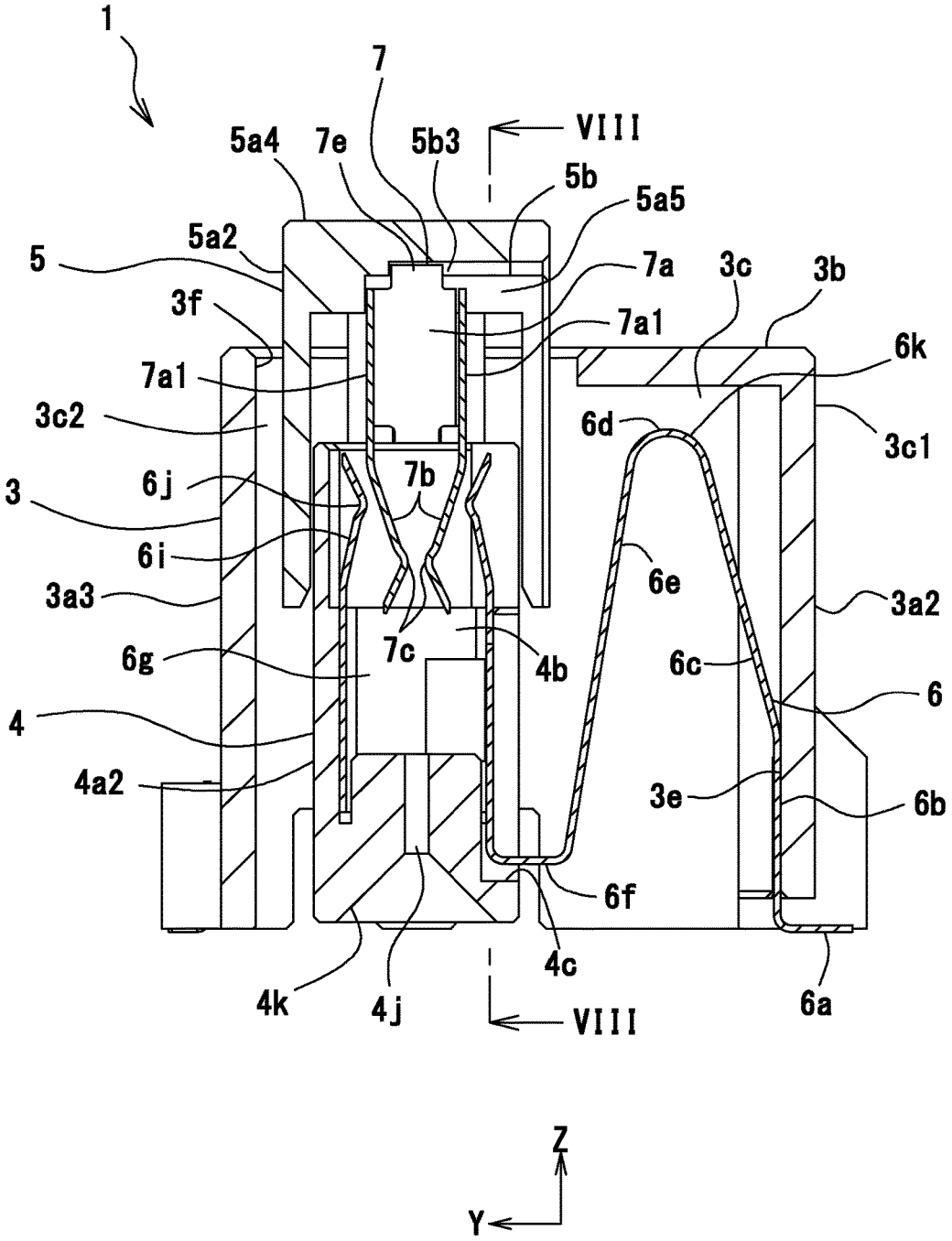
FIG. 6 is an enlarged sectional view of FIG. 2 taken along line VI-VI.

Thus, the relay terminal 7 is retained without being fixed to the operation housing 5 by inserting the projections 7*e* into the retaining grooves 5*b* in the operation housing 5. As illustrated in the enlarged view of FIG. 2, gaps 5*b*1 that extend in the X direction and gaps 5*b*2 that extend in the Z direction are formed between the projections 7*e* and the retaining grooves 5*b*. As illustrated in FIG. 6, gaps 5*b*3 that extend in the Y direction are also provided, so that the projections 7*e* are movable in the Y direction along the retaining grooves 5*b*. Thus, the relay terminal 7 is attached to the operation housing 5 with clearances that enable the relay terminal 7 to move in the X, Y, and Z directions. The movement restricting piece 7*d* and the sheath-shaped portion 4*i* also have gaps therebetween that extend in the X, Y, and Z directions. However, the sheath-shaped portion 4*i* functions as a stopper that prevents the movement restricting piece 7*d* from moving excessively forward in the Y direction.

Operation and Effects of Movable Connector 1

The operation and effects of the above-described movable connector 1 according to the first embodiment will now be described.

Assembly of Movable Connector 1

To assemble the movable connector 1, the movable-housing fixing portions 6*h* of the substrate connection terminals 6 are fixed to the terminal fixing portions 4*d* of the movable housing 4, and the relay terminals 7 are attached to the operation housing 5. Then, the operation housing 5 is attached to the movable housing 4 from above. At this time, the front wall 5*a*1 and the back wall 5*a*2 of the operation housing 5 are respectively guided along the front wall 4*a*1 and the back wall 4*a*2 of the movable housing 4, so that the operation housing 5 can be smoothly attached to the movable housing 4.

When the engagement lugs 5*c*1 of the stopper pieces 5*c* of the operation housing 5 slide over the engagement steps 4*e*1 of the movable housing 4, the stopper pieces 5*c* return from the bent state, and thereby provide a click sensation. Thus, the temporarily fitted state is established in which the engagement lugs 5*c*1 are engaged with the engagement steps 4*e*1 in the pulling direction of the operation housing 5 so that the operation housing 5 is prevented from being pulled out. In the temporarily fitted state, the two stopper pieces 5*c* at each side of the operation housing 5 are placed in the corresponding guide portions 4*g*, and the corresponding lock arm 4*f* of the movable housing 4 is placed between the two stopper pieces 5*c*, so that the operation housing 5 and the movable housing 4 are guided to move straight in the Z direction. In addition, the movement restricting piece 7*d* of each relay terminal 7 is inserted in the corresponding sheath-shaped portion 4*i* of the movable housing 4, so that the operation housing 5 can be smoothly attached to the movable housing 4 without causing each relay terminal 7 to fall therefrom.

Next, the operation housing 5 is inserted into the interior space 3*c* of the fixed housing 3 so that the operation housing 5 projects from the insertion opening 3*f*. Also, the fixed-housing fixing portions 6*b* of the substrate connection terminals 6 are press-fitted to the terminal fixing portions 3*e* of the fixed housing 3. The assembly of the movable connector 1 is completed by attaching the fixed housing 3 in the above-described manner. The movable connector 1 is mounted on the substrate P by soldering the fixing piece 3*g* and the substrate connection portions 6*a* of the substrate connection terminals 6 to the substrate P.

Conductive Connection between Movable Connector 1 and Connection Object

The operation and effects of conductive connection between the movable connector 1 and each pin terminal 8 will now be described.

Each pin terminal 8 is inserted into the movable connector 1 through a through hole P2 from the back of the substrate P. Each insertion hole 4*j* in the movable housing 4 has the tapered portion 4*k*. Therefore, even when the central axis of the pin terminal 8 is displaced from the axis of the corresponding insertion hole 4*j*, the tapered portion 4*k* guides the pin terminal 8 to correct the insertion direction thereof.

When the pin terminal 8 is further inserted, as illustrated in FIG. 9, the pin terminal 8 stops before coming into contact with the contact portions 7*c* of the relay terminal 7. At this position, the pin terminal 8 is brought into conductive contact with and fitted to the movable connector 1. In this manner, the pin terminal 8 is inserted to a normal fitting position without contact with the substrate connection terminal 6 or the relay terminal 7. Thus, the movable connector 1 is a zero insertion force (ZIF) connector that does not receive an insertion force applied to the pin terminal 8. Accordingly, the insertion force applied to the pin terminal 8 is not applied to solder portions by which the movable connector 1 is fixed to the substrate P, more specifically, the solder portion (not shown) on the fixing piece 3*g* and the solder portion P1 on the substrate connection portion 6*a* of each substrate connection terminal 6. As a result, formation of cracks and separation of the movable connector 1 from the substrate P due to the insertion force can be prevented.

Next, the top wall 5*a*4 of the operation housing 5 that projects upward from the top portion 3*b* of the fixed housing 3 is pushed to move the operation housing 5 into the interior space 3*c* of the fixed housing 3. Accordingly, first, the pair of contact portions 7*c* of the relay terminal 7 come into pressure contact with the pin terminal 8 so as to clamp the pin terminal 8 in the Y direction. Shortly after that, the pair of contact portions 6*j* of the substrate connection terminal 6 come into pressure contact with the elastic arms 7*b* of the relay terminal 7. Accordingly, the elastic arms 7*b* are pressed toward the axis of the pin terminal 8 by the contact portions 6*j*, so that the contact pressure between the pin terminal 8 and the contact portions 7*c* is increased. Therefore, the contact portions 7*c* of the relay terminal 7 are moved downward in the Z direction while being pressed against the pin terminal 8 at a large contact pressure. At this time, foreign matter on the surface of the pin terminal 8 can be removed by the contact portions 7*c* (wiping effect). Thus, the contact portions 7*c* can be conductively connected to the pin terminal 8 in such a state that the foreign matter is removed.

When the operation housing 5 is further pushed, the engagement lugs 4*f*1 of the lock arms 4*f* of the movable housing 4 slide over the locking projections 5*d* of the operation housing 5, and the lock arms 4*f* return from the bent state to provide a click sensation. Accordingly, the engagement lugs 4*f*1 are engaged with the engagement surfaces 5*d*1 of the locking projections 5*d* in the pulling direction of the operation housing 5, so that the operation housing 5 is prevented from being pulled out. Thus, the operation housing 5 and the movable housing 4 are completely fitted to each other, and the pin terminal 8 is fitted (conductively connected) to the movable connector 1, as illustrated in FIG. 10. As described above, simply by pushing the operation housing 5 in the temporarily fitted state, the movable connector 1 can be conductively connected to the pin terminal 8, and the operation housing 5 and the movable housing 4 can be set to the completely fitted state.

In the completely fitted state, each relay terminal 7 is in conductive contact with the pin terminal 8 and the pair of contact portions 6*j* of the corresponding substrate connection terminal 6 in the corresponding connection chamber 4*b* of the movable housing 4. Accordingly, the overall size of the movable connector 1 can be made smaller than a connector according to the related art in which a first female terminal and a second female terminal are arranged in parallel.

In the above-described pushing operation of the operation housing 5, the operation housing 5 is ideally pushed straight toward the substrate P. However, since the movable connector 1 is small and the area of the top wall 5*a*4, which serves as the pushing operation surface, is even smaller, it is very difficult to push the top wall 5*a*4 at the center. Therefore, the top wall 5*a*4 is normally pushed obliquely at a position displaced from the center. However, even when a pushing force is applied so as to tilt the operation housing 5 and the movable housing 4, since the support springs 6*k* of the substrate connection terminals 6 are soft and elastically deformable, each pin terminal 8 can be fitted while allowing displacements of the operation housing 5 and the movable housing 4 in the tilted state.

Unlike a spring according to the related art, each support spring 6*k* has an inverted U-shape in the support spring accommodating section 3*c*1, which is obtained by dividing the interior space 3*c* of the fixed housing 3. Thus, each support spring 6*k* has a simple shape and a long spring length. Therefore, a floating function of softly supporting the movable housing 4 and the operation housing 5 can be realized.

The elastic arms 7*b* of each relay terminal 7 extend in the Z direction so that the pair of contact portions 7*c* of the relay terminal 7 are positioned inside the base portion 6*g* of the corresponding substrate connection terminal 6. The elastic arms 6*i* of each substrate connection terminal 6 extend from the base portion 6*g* so that the pair of contact portions 6*j* of the substrate connection terminal 6 come into pressure contact with the base portion 7*a* (plate pieces 7*a*1) of the corresponding relay terminal 7 so as to clamp the base portion 7*a* in the Y direction from the outside. Thus, the relay terminal 7, which is in conductive contact with the pin terminal 8, is conductively connected to the substrate connection terminal 6. In addition, since the pair of contact portions 6*j* of the substrate connection terminal 6 come into pressure contact with the relay terminal 7, the substrate connection terminal 6 can be retained so that it is not displaced relative to the relay terminal 7 even when the movable housing 4 is moved due to, for example, vibration. Accordingly, the position at which the contact portions 7*c* of the relay terminal 7 are in contact with the pin terminal 8 can be maintained, and reduction in connection reliability due to fine sliding abrasion of the contact portions 7*c* and the pin terminal 8 can be prevented.

With regard to the arrangement of the substrate connection terminal 6 and the relay terminal 7, the relay terminal 7, which is small enough to be insertable into the base portion 6*g* of the substrate connection terminal 6, is arranged so as to overlap the substrate connection terminal 6 in the Z direction, as described above. Accordingly, the dimension of the movable connector 1 in the Z direction can be reduced. The elastic arms 6*i* and the pair of contact portions 6*j* of the substrate connection terminal 6 and the elastic arms 7*b* and the pair of contact portions 7*c* of the relay terminal 7 extend from the edges of the base portions 6*g* and 7*a* that extend in the X direction, and oppose each other in the Y direction. Accordingly, compared to the case in which they do not oppose each other, the substrate connection terminal 6 and the relay terminal 7 can be arranged with smaller gaps therebetween. Thus, the dimension of the movable connector 1 in the Y direction can also be reduced.

If, for example, the projections 7*e* of the relay terminal 7 are press-fitted and fixed to the retaining grooves 5*b* in the operation housing 5, the central axis of the relay terminal 7 will be displaced from the midpoint between the contact portions 6*j* of the substrate connection terminal 6 in the Y direction unless the projections 7*e* are press-fitted to the retaining grooves 5*b* at an accurate position. In such a case, a large load is placed on one of the contact portions 6*j* and one of the elastic arms 6*i* of the substrate connection terminal 6, and there is a risk that fatigue of that elastic arm 6*i* will lead to a reduction in connection reliability. However, the relay terminal 7 is held in a movable manner, and is not fixed to the operation housing 5. Therefore, when the contact portions 6*j* of the substrate connection terminal 6 come into pressure contact of the relay terminal 7, the relay terminal 7 can be reliably arranged so that the central axis thereof coincides with the midpoint between the contact portions 6*j*.

Second Embodiment (FIGS. 11 to 14)

The second embodiment differs from the first embodiment in that each substrate connection terminal 6 does not include the pair of elastic arms 6*i* and the pair of contact portions 6*j*. The second embodiment also differs from the first embodiment in that each relay terminal 7 includes acutely bent portions 7*f*, which serve as "spring portions", and a pair of terminal connection contact portions 7*g*, which serve as "second contact portions". The acutely bent portions 7*f* extend from the pair of contact portions 7*c*, and are bent. The terminal connection contact portions 7*g* extend from the acutely bent portions 7*f* and come into conductive contact with the base portion 6*g* (plate pieces 6*g*1) of the corresponding substrate connection terminal 6. Other structures, operation, and effects of the second embodiment are the same as those of the first embodiment. Therefore, only the differences will be described.

In the first embodiment, the elastic arms 6*i* and the contact portions 6*j* of each substrate connection terminal 6 are brought into conductive contact with the corresponding relay terminal 7. In the second embodiment, the acutely bent portions 7*f* and the terminal connection contact portions 7*g* of each relay terminal 7 are brought into conductive contact with the corresponding substrate connection terminal 6. The elastic arms 7*b*, the contact portions 7*c*, the acutely bent portions 7*f*, and the terminal connection contact portions 7*g* of the relay terminal 7 according to the present embodiment serve as "second contact pieces" according to the present invention.

Figure 13:
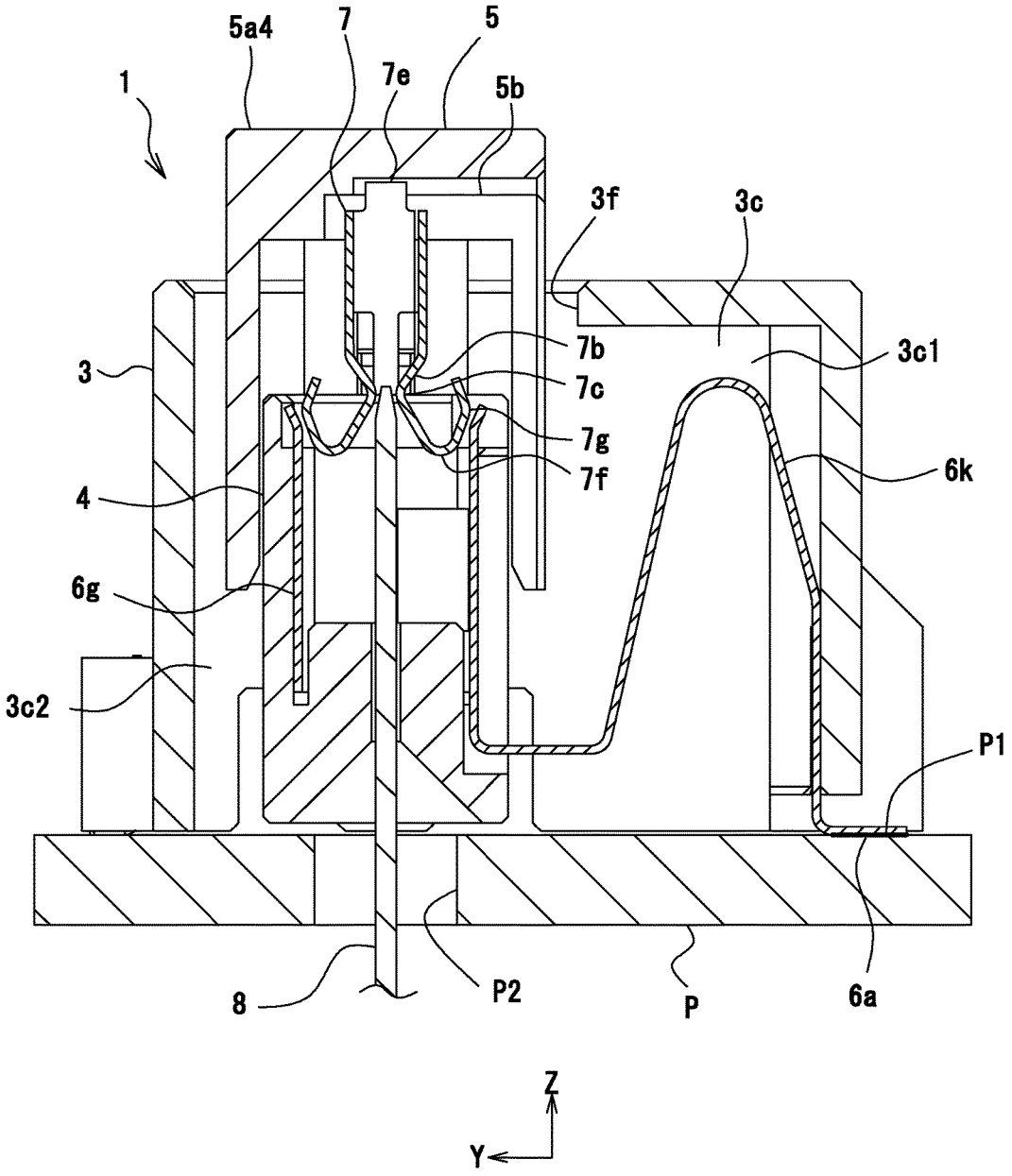
FIG. 13 is an enlarged sectional view corresponding to FIG. 6, illustrating the movable connector of FIG. 11 in a fitting process.
Figure 14:
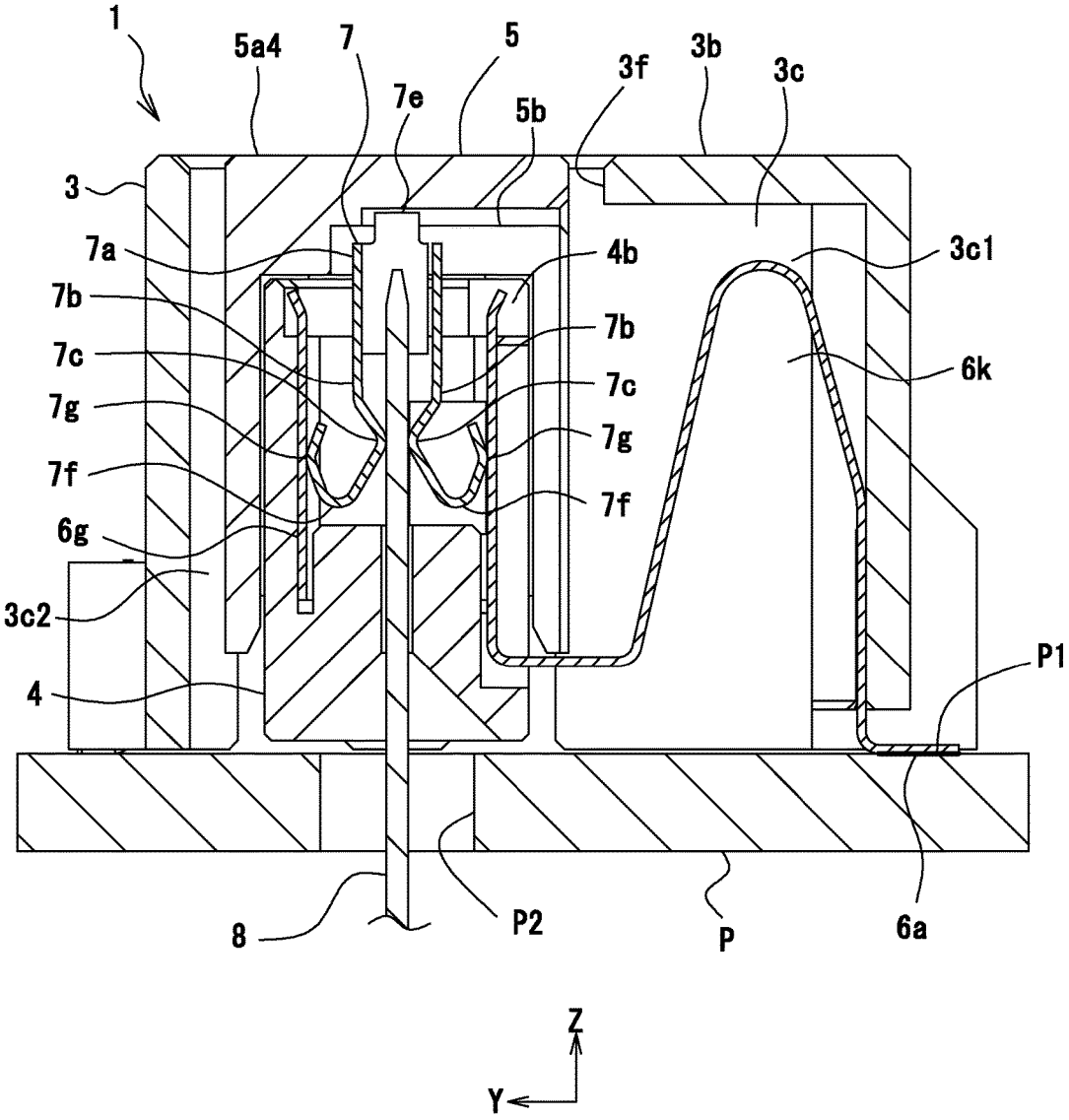
FIG. 14 is an enlarged sectional view corresponding to FIG. 6, illustrating the movable connector in a completely fitted state after the state illustrated in FIG. 13.

In the movable connector 1 according to the second embodiment, when the operation housing 5 in the temporarily fitted state illustrated in FIG. 13 is pushed, the contact portions 7*c* of the relay terminal 7 come into pressure contact with the pin terminal 8 and the terminal connection contact portions 7*g* come into pressure contact with the base portion 6*g* of the substrate connection terminal 6 at substantially the same time. When the terminal connection contact portions 7*g* come into pressure contact with the base portion 6*g*, the acutely bent portions 7*f* exert a reaction force that presses the contact portions 7*c* against the pin terminals 8. Thus, the contact portions 7*c* are in pressure contact with the pin terminal 8 at a large contact pressure, so that the position at which the contact portions 7*c* are in contact with the pin terminal 8 can be reliably maintained even when the movable housing 4 is moved due to, for example, vibration. The terminal connection contact portions 7*g* are also in pressure contact with the base portion 6*g* at a large contact pressure. This also contributes to maintaining the position at which the contact portions 7*c* are in contact with the pin terminal 8 when the movable housing 4 is moved due to, for example, vibration. Therefore, reduction in connection reliability due to fine sliding abrasion of the contact portions 7*c* and the pin terminal 8 can be prevented.

What is claimed is:

1. A movable connector comprising:

a fixed housing to be fixed to a substrate;

a movable housing disposed in the fixed housing and into which a connection object is to be inserted;

a substrate connection terminal including a substrate connection portion to be soldered to the substrate, a support spring that supports the movable housing so that the movable housing is movable with respect to the fixed housing, and an inner contact section disposed in the movable housing;

an operation housing that is combined with the movable housing as a result of a pushing operation in which the operation housing is pushed into an interior space of the fixed housing; and a relay terminal that moves together with the operation housing in the pushing operation and comes into conductive contact with the connection object and the inner contact section of the substrate connection terminal in the movable housing.

2. The movable connector according to claim 1, wherein the interior space of the fixed housing includes a housing accommodating section that accommodates the movable housing and the operation housing and a support spring accommodating section in which the support spring extends.

3. The movable connector according to claim 1, wherein the substrate connection terminal includes a first contact piece that comes into pressure contact with the relay terminal in the pushing operation.

4. The movable connector according to claim 1, wherein the relay terminal includes a second contact piece that comes into pressure contact with the connection object and the substrate connection terminal in the pushing operation.

5. The movable connector according to claim 4, wherein the second contact piece includes a first contact portion that comes into conductive contact with the connection object, a second contact portion that comes into pressure contact with the substrate connection terminal, and a spring portion that connects the first contact portion to the second contact portion and exerts a reaction force that presses the first contact portion against the connection object when the second contact portion comes into pressure contact with the substrate connection terminal.

6. The movable connector according to claim 1, wherein the relay terminal includes a projection, wherein the operation housing has a retaining groove in which the projection is retained in a movable manner with a gap provided therebetween, and wherein the relay terminal is movable with respect to the operation housing over a range defined by the gap.

7. The movable connector according to claim 1, wherein the substrate connection terminal includes a first base portion held by the movable housing, wherein the relay terminal includes a second base portion held by the operation housing, and wherein the first base portion and the second base portion are arranged in a pushing direction in which the operation housing is pushed in the pushing operation.

8. The movable connector according to claim 1, wherein the operation housing and the movable housing include temporarily-fitted-state retaining portions that restrain a movement of the operation housing in a pushing direction in which the operation housing is pushed in the pushing operation and a pulling direction that is opposite to the pushing direction in a temporarily fitted state before the operation housing and the movable housing are combined together in a completely fitted state.

9. The movable connector according to claim 1, wherein the operation housing and the movable housing include completely-fitted-state retaining portions that restrain a movement of the operation housing in a pulling direction in which the operation housing is pulled out of the movable housing in a completely fitted state in which the operation housing and the movable housing are combined together.

* * * * *